United States Patent [19]

White et al.

[11] 4,062,764

[45] Dec. 13, 1977

[54] METHOD FOR NEUTRALIZING ACIDIC COMPONENTS IN PETROLEUM REFINING UNITS USING AN ALKOXYALKYLAMINE

[75] Inventors: James A. White, Richmond; Thomas C. Maynard, Houston, both of Tex.

[73] Assignee: Nalco Chemical Company, Oak Brook, Ill.

[21] Appl. No.: 709,347

[22] Filed: July 28, 1976

[51] Int. Cl.[2] ..... C10G 7/00; C23F 11/04; C23F 11/14

[52] U.S. Cl. ..... 208/348; 21/2.5 R; 21/2.5 B; 21/2.7 R; 203/7; 208/47; 252/392

[58] Field of Search ..... 21/2.5 R, 2.5 B, 2.7 R; 203/7; 208/47, 348; 252/392

[56] References Cited

U.S. PATENT DOCUMENTS

| | | | |
|---|---|---|---|
| 2,295,709 | 9/1942 | Bock | 21/2.5 R UX |
| 3,078,223 | 2/1963 | Thompson | 21/2.5 R X |
| 3,203,904 | 8/1965 | Brown | 21/2.5 B UX |
| 3,447,891 | 6/1969 | Crawford | 21/2.5 R |
| 3,458,453 | 7/1969 | Kautsky | 203/7 X |
| 3,524,719 | 8/1970 | Wolf et al. | 21/2.7 R |
| 3,642,653 | 2/1972 | Norman et al. | 21/2.5 R X |
| 3,649,167 | 3/1972 | Sawyer | 21/2.5 R |
| 3,779,905 | 12/1973 | Stedman | 203/7 X |
| 3,799,876 | 3/1974 | White et al. | 252/392 X |
| 3,819,328 | 6/1974 | Go | 21/2.5 R |

*Primary Examiner*—Barry S. Richman
*Attorney, Agent, or Firm*—John G. Premo; Barry W. Sfrin; Robert A. Miller

[57] ABSTRACT

A method of neutralizing acidic components in petroleum refining units in which distillation is taking place, which method comprises adding a compound corresponding to Formula I below either alone or in combination with a film-forming amine to the petroleum product being distilled:

Formula I $$R—O—(CH_2)_n NH_2$$

wherein $n$ is 2 or 3 and R is a lower alkyl radical of not more than 4 carbon atoms.

20 Claims, No Drawings

METHOD FOR NEUTRALIZING ACIDIC COMPONENTS IN PETROLEUM REFINING UNITS USING AN ALKOXYALKYLAMINE

BACKGROUND

The present invention is directed to the prevention or control of corrosion of oil refining equipment. More particularly, the subject invention is directed to a process for eliminating acid corrosion which takes place at the point of initial water condensation in petroleum distillation units.

Petroleum crudes as well as gas oil, reduced crude, etc., are subjected to various processes in order to form lower boiling components such as gasoline. The product that is obtained from conversion is distilled to produce a gasoline fraction, a fuel oil fraction, lubricating oil fraction, etc. The lower boiling fractions and particularly gasoline are recovered as an overhead fraction from the distilling zones. The intermediate components are recovered as side cuts from the distillation zone. The fractions are cooled, condensed, and sent to collecting equipment. No matter what the source of the oil that is subject to distillation, it has been found that corrosion of the equipment takes place. Acidic materials that are present in all crudes are carried along from the distillation zone with the distillate product and often cause extensive corrosion to take place on the metal surfaces of fractionating towers such as crude towers, trays within such towers, heat exchangers, receiving tanks, connecting pipes, etc. The most serious corrosion occurs in condensers and in the overhead line leading from the fractionating towers. The overhead line is used as a connection between the distillation tower and condensers. The distillate or stock which will be stored or used subsequently to charge other refining processes is condensed on the cooled surfaces of the condenser equipment and is then caught in an overhead accumulator drum. A portion of the distillate is recycled to the crude pot with the remainder being transferred to other refinery units.

One of the chief points of difficulty with respect to corrosion occurs in the area of the initial condensation of water that is carried over in the overhead line. The top temperature of the fractionating column is maintained above the boiling point of water. The initial condensate formed after the vapor leaves the column contains a high percentage of acidic materials such as hydrogen sulfide, hydrogen cyanide, $CO_2$, HCl, etc. Due to the high concentration of acids dissolved in the water, the pH of the first condensate is quite low. For this reason the water is highly corrosive. It is important, therefore, that the first condensate be rendered less corrosive.

In the past, ammonia has been added at various points in the distillation circuit in an attempt to control the corrosiveness of condensed acidic materials. Ammonia, however, has not proven to be effective with respect to eliminating corrosion caused by the initial condensate. It is believed that ammonia has been ineffective for this purpose because it does not condense quickly enough to neutralize the acidic components of the first condensate. The ammonia tends to stay in the vapor phase until at least the point of the second condensation.

When using certain film-forming anticorrosive agents, it has been found that a far more economical system is set up where the pH of the condensed liquids is maintained above about 4.5, and preferably, at least about 5.0. This is true of virtually all amine film-forming inhibitors. A corrosion inhibitor of the film-forming type should be soluble in both aliphatics and aromatics in order to be dispersed throughout the stock. The inhibitors also should not tend to promote emulsification of the aqueous hydrocarbon phases.

At the present time morpholine is used successfully to control or eliminate corrosion that ordinarily occurs at and beyond the point of initial condensation of vapors within or leaving the distillation unit. The addition of morpholine to the crude substantially raises the pH of the initial condensate rendering the material noncorrosive or substantially less corrosive than was previously possible. The inhibitor can be added to the system either in pure form or as an aqueous solution. A sufficient amount of morpholine is added to raise the pH of the liquid at the point of initial condensation to above 4.0 and, preferably, to at least about 5.0. The term "initial condensate" as it is used herein signifies a phase formed when the temperature of the surrounding environment reaches the dew point of water. At this point a mixed phase of liquid water, hydrocarbon and vapor may be present. As is evident from the above discussion, such initial condensate may occur within the distilling unit itself or in subsequent conductors.

The use of morpholine either alone or in combination with so-called film-forming inhibitors is disclosed and claimed in U.S. Pat. No. 3,447,891, the disclosure of which is made a part hereof.

Commercially, morpholine has proven itself to be successful in treating may crude distillation units. In addition to using morpholine, other amines have been used, most notably cyclohexylamine either alone or in combination with morpholine. Another commercial product that has been used for the past several years in these applications is hexamethylenediamine.

A specific problem has developed in connection with the use of these amines for treating initial condensate. This problem relates to the hydrochloride salts of these amines which tend to form deposits in distillation columns, column pumparounds, overhead lines and in overhead heat exchangers. These deposits manifest themselves after the particular amine has been used for a long period of time. Morpholine is the least offensive from a deposit standpoint but still forms deposits when used over protracted periods of time.

If it were possible to find an amine which was as effective as morpholine or other amines for treating initial condensate which did not tend to form deposits over protracted periods of use, an advance in the art would be made. It would be a valuable contribution to the art if a non-deposit forming neutralizing amine could be devised which would overcome the corrosion problems found at the point of initial condensation in a distillation unit especially if the amine is compatible with film-forming inhibitors. This would provide much improved overall protection of the refinery equipment. The subject invention is believed to represent such a contribution to the art.

OBJECTS

It is an object of the present invention to provide a method of neutralizing acidic components in refining equipment and, particularly, in overhead lines and condensers, and, more particularly, at the point of initial condensation of the vapors occurring within the tower or in lines or condensers connected to the tower.

An important object of the invention is the provision of an inhibitor capable of functioning as described above which does not tend to form deposits in refinery equipment when used for protracted periods of time.

THE INVENTION

The invention comprises the discovery that the addition of a minor amount of a composition corresponding to Formula I below:

Formula I $$R—O—(CH_2)_n NH_2$$

wherein $n$ is 2 or 3 and R is a lower alkyl radical of not more than 4 carbon atoms, to a crude oil charge or at various other points in the system effectively eliminates and/or controls corrosion that ordinarily occurs at and beyond the point of initial condensation of vapors within or leaving the distilling unit. Illustrative of compounds falling within composition I are methoxypropylamine (MOPA), ethoxypropylamine, methoxyethylamine, and the like. The most preferred compound is MOPA. To simplify further discussions herein of the invention, it will be illustrated by using MOPA although it is understood that the other compounds falling within Formula I are also operative.

In addition to controlling and preventing corrosion, MOPA has the distinct advantage of not forming deposits when used to treat such systems for prolonged periods of time.

MOPA can be added to the unit in any one of several places. First of all, MOPA can be added to the crude oil charge. This is a highly convenient method of carrying out the process since it will also neutralize condensate within the tower and in recirculating lines. The inhibitor can also be pumped directly into the gaseous overhead line. MOPA can also be passed into the reflux line or can be added to recirculating $H_2O$ at the top of the column. The particular point at which MOPA is added will depend largely on the design of the particular equipment, the personal preferences of the operator, and the point where corrosion is most severe.

In many systems it is feasible to recirculate the water that condenses in the overhead system. In this particular operation a much lower quantity of MOPA is required to provide a highly satisfactory process. It has been found, for example, that the addition of as little as 4 ppm of MOPA to crude oil stock based on the weight of the gross overhead provides a highly satisfactory system where the condensate water is recirculated. If the water is discarded rather than recirculated, an increased amount of MOPA may be required to raise the pH of the first condensate above 4.5. The amount required can readily be determined by taking periodic pH readings or reading "Corrosometer" probes. The upper limit of the addition level depends largely on economic considerations. Unlike systems containing ammonia, it is not as essential that the pH be maintained below a given point. MOPA as employed in the invention has no adverse effect on copper alloys and the like.

As was pointed out above, the use of MOPA to control the corrosiveness of the initial condensate lends itself well to the joint use of film-forming corrosion inhibitors. Such film-forming inhibitors operate most economically at a pH above 4.5. Due to the fact that MOPA is particularly effective in increasing the pH of the initial condensate, the amount of film former that is required is substantially lessened.

Among the film-forming corrosion inhibitors which can be used in conjunction with MOPA to provide an overall system of protection are compounds formed by reacting certain aliphatic monoamines with polymerized fatty acids under salt-forming conditions.

The aliphatic monoamines used in preparing film-forming inhibitors are those amines having the general structural formula:

$$R—\overset{\overset{R_2}{|}}{N}—R_3$$

where R is an aliphatic hydrocarbon radical of 8 to 22 carbon atoms in chain length and both $R_2$ and $R_3$ are selected from the group consisting of hydrogen and an aliphatic hydrocarbon radical of 1 to 22 carbon atoms in chain length.

The above structural formula includes both primary and secondary aliphatic monoamines as well as the tertiary aliphatic monoamines. Illustrative compounds coming within the above general formula include such primary amines as n-dodecyl amine, n-tetradecyl amine, n-hexadecylamine, lauryl amine, myristyl amine, palmityl amine, stearyl amine, and oleyl amine. Other commercially available primary amines include coconut oil amine, tallow amine, hydrogenated tallow amine and cottonseed oil amine. Useful secondary amines are dilauryl amine, dimyristyl amine, dipalmityl amine, distearyl amine, dicoconut amine and dihydrogenated tallow amine. In the case of many of the above amines, it will be noted that the source of alkyl substituent on the organic nitrogen is derived from a mixed vegetable oil or animal fat. For purposes of convenience, these compounds have been named from the derivative alkyl-containing components. This system of nomenclature, particularly in the case of alkyl substituents derived from naturally occurring products such as fats, oils and the like, is used for purposes of simplification. It is believed that those familiar with the art will readily understand that the alkyl substituent varies in the case of a coconut substituent with the alkyl groups containing from 8 to 18 carbon atoms in chain length. Similarly, in the case of hydrogenated tallow, the alkyl substituent will vary from about 12 to 20 carbon atoms in chain length.

In addition to using primary or secondary amines as exemplified above, tertiary amines such as octyl dimethyl amine, octadecyl dimethyl amine, octadecyl methyl benzyl amine, hexyldiethylamine, trilaurylamine, tricoconut amine, tricaprylyl amine, and similar type compounds also may be used.

Preferred aliphatic primary monoamines are amines having the general structural formula:

$$R—NH_2$$

wherein R is an aliphatic hydrocarbon radical of from 8 to 22 carbon atoms in chain length. A preferred material of this type is the commercial product "Armeen SD" sold by the Armour Industrial Chemical Company, which is known generically to the art as Soya amine. As applied to the above formula the R group is a mixed aliphatic radical which has the following components:

| | Percent |
|---|---|
| Hexadecyl | 10 |
| Octadecyl | 10 |
| Octadecenyl | 35 |
| Octadecadienyl | 45 |

Out of the group of tertiary amines listed above, one of the most effective is dimethyl hydrogenated tallow amine. This preferred species may be considered as an ammonia molecule which has had its three hydrogen atoms replaced by three alkyl groups. Two of these alkyl groups are methyl and the third is a mixed alkyl substituent derived from hydrogenated tallow.

A representative analysis of the mixed radicals of the hydrogenated tallow group is as follows:

| | Percent |
|---|---|
| Myristic | 2 |
| Palmitic | 29 |
| Stearic | 68 |
| Oleic | 1 |

One of the preferred commercial sources of this tertiary amine is "Armeen $M_2HT$" sold by Armour Industrial Chemical Company.

The polymerized fatty acids are well known and have been described in numerous publications. Excellent descriptions of these materials may be found in Industrial and Engineering Chemistry, 32, page 802 et seq. (1940), and in the text "Fatty Acids" by Klare S. Markley, published by Interscience Publishers, Inc., New York City, 1947, pages 328 to 330. An specific example of such a polymer which has been found to be particularly useful is one which is prepared as a by-product of the caustic fusion of castor oil in the manufacture of sebacic acid. This material is composed primarily of dicarboxylic acids derived by bimolecular addition in an olefinic polymerization where linkage occurs through the opening of at least two unsaturated bonds. Typical properties of a material so obtained are as follows:

| | |
|---|---|
| Acid value | 150 |
| Saponification value | 172 |
| Unsaponifiable matter, percent | 3.7 |
| Iodine No | 36 |
| Moisture content, percent | 0.86 |

The material is, of course, not pure but predominantly contains dicarboxylate polymers having about 34 to 36 atoms. A suitable commercial source of this dimer acid is Harchem Division of Wallace and Tiernan, Inc., and is known as "Century D-75 Acid."

A typical film-forming corrosion inhibitor useful in conjoint activity with MOPA may be prepared by combining 1 weight part of "Armeen SD" and 2.57 weight parts of a polymerized fatty acid obtained as the residue of a dry distillation of castor oil with sodium hydroxide and reacting the mixture with stirring at a temperature of 60° C. for 20 minutes. The final reaction product is then dispersed in equal weight parts of a heavy aromatic solvent.

Another useful film-forming corrosion inhibitor composition is prepared by heating 14 parts of "Armeen $M_2HT$" to the melting point and adding thereto 36 parts of "Century D-75 Acid," The mixture was reacted for 10 minutes at 130° - 150° F. and the resultant product added to a heavy aromatic solvent in equal proportions by weight of product to solvent.

| | | |
|---|---|---|
| Distillation range | mm. | 760 |
| Initial boiling point | ° C. | 171 |
| Percent: | | |
| 10 | ° C. | 184 |
| 50 | ° C. | 230 |
| 90 | ° C. | 260 |
| End point | ° C. | 278 |

In reacting the above recited amines with polymerized fatty acids to obtain the film-forming compositions, care should be taken to maintain salt-forming conditions. This is done primarily by using reaction temperatures of from 25° to 100° C., and by avoiding the presence of materials which cause the splitting out of water. This environment is sometimes referred to as "neutralizing conditions". It is the salt producible from the above listed reactants which is of primary interest in the instant invention. Further care must be taken in conducting the reaction to eliminate the possibility of the presence of free amines in the final reaction product. Reaction proportions conducive to accomplishing this typically include the above recited use of a weight ratio of typical polymer to typical monoamine of 2.57:1.

Additional film-forming compositions that can be used in conjunction with the subject inhibitor include those disclosed in U.S. Pat. No. 3,003,955 among others.

EXAMPLES

To evaluate the ability of MOPA to prevent initial condensate corrosion without forming deposits, it was tested along with other neutralizing amines to determine its efficacy both from the standpoint of preventing corrosion, its ability to neutralize aqueous solutions of acids and to be incapable of forming deposits under normal conditions of use.

To evaluate the invention, a laboratory glassware unit was constructed. The unit consists of a two-inch diameter, fifteentray, glass Oldershaw column fitted with a reboiler and overhead system similar to crude distillation units. Preheated naphtha is charged into the column at Tray 5 where it cascades downward and mixes with hot vapor rising from the reboiler. Usually, a small sidecut is taken from Tray 10. Warm reflux is pumped from the overhead receiver back to Tray 15 (top tray) to partially cool the hot vapors coming up the column and going overhead. A solution of dilute hydrochloric acid provides both the water and hydrochloric acid vapor for the test unit. The acid solution is flashed in a constant-temperature oil bath at 170° - 180° C. and injected into the top section of the reboiler. Heated neutralizer is fed into the reflux line to neutralize the acid vapor coming up the column. An alternate configuration consists of feeding the neutralizer into the overhead vapor line. Feeding neutralizer into the reflux causes more rapid salt buildup in the column than feeding into the overhead vapor line and, therefore, shortens the amount of time required for each test run. In all test runs, sufficient neutralizer was fed into the system to obtain approximately the same pH level.

Deposit formation is observed visually and by chloride analysis of the charge and effluent streams. At the end of each run, the column head is removed and wash water is poured into the column. This wash water is partially refluxed overhead to remove deposits in the overhead line. The two samples of wash water, resulting from washing the column and overhead, are then analyzed for chlorides to determine the amount of deposits in the column and overhead line. A material balance is made by adding up the amount of chlorides obtained from each source and comparing with the amount of chlorides charged to the unit.

In order to provide a satisfactory test in a limited amount of time, the test unit was operated on a continuous basis and the amount of hydrochloric acid charged was 50 ppm active basis overhead product, about 15 to 20 times the level usually observed in a crude distillation unit. Operating conditions were selected to provide a satisfactory test in a 20 to 24-hour period.

To evaluate the invention and compare it against other commercial amines, the following compositions were tested;

Composition 1: 40% MOPA in heavy aromatic solvent;

Composition 2: 40% Morpholine in heavy aromatic solvent;

Composition 3: Crude Hexamethylenediamine;

Composition 4: Crude Diaminocyclohexane;

Composition 5: Crude Amyl Amine; Composition 6: A concentrated organic solvent solution of a blend of:

1, 2 - Diamino cyclohexane;

2 -Methyl-Pentamethylene Diamine;

2-(Amino Methyl) Cyclopentylamine, Hexamethylene Diamine.

The results of these studies are presented in Tables I, II, III, and IV.

TABLE I

| | Charge: Heavy Naphtha | | | | | | | |
|---|---|---|---|---|---|---|---|---|
| Neutralizer | Comp. 2 | Comp. 2 | Comp. 3 | Comp. 3 | Comp. 4 | Comp. 4 | Comp. 1 | Comp. 5 |
| Hours run | 30 | 22 | 28 | 23 | 23 | 11 | 22 | 16 |
| Water, % basis OH | 3.7 | 4.0 | 4.2 | 3.7 | 3.0 | 4.3 | 3.7 | 4.3 |
| Chlorides charged ppm basis OH | 50 | 50 | 50 | 50 | 50 | 50 | 50 | 50 |
| Chlorides in column, % | 25 | 14 | 37 | 39 | 39 | 41 | 12 | 15 |
| Chlorides in OH, % | 11 | 19 | 2 | 4 | 2 | 2 | 12 | 2 |
| Chlorides in solution, % | 62 | 67 | 51 | 54 | 59 | 51 | 59 | 63 |
| Flooding | No | No | No | No | Yes | Yes | No | Yes |
| Visual Inspection | Clean, V. lt. depos. tray 15. | Clean, V. lt. depos. tray 15. | Deposits trays 10 – 15. | Deposits trays 10 – 15 | Deposits trays 10 – 15 | Deposits trays 10 – 15. | Clean no depos. | Deposit OH and trays 13 – 15. |

TABLE II

| | Charge: Heavy Naphtha | | | | |
|---|---|---|---|---|---|
| Neutralizer | Comp. 1[1] | Comp. 1[2] | Comp. 1[3] | Comp. 1[3] | Comp. 1[3] |
| Injection point | Reflux line | Reflux line | Reflux line | Reflux line | Reflux line |
| Hours run | 22.0 | 20.0 | 22.0 | 23.0 | 22.0 |
| Water, % basis OH | 3.7 | 3.7 | 4.6 | 3.8 | 3.8 |
| Chlorides charged, ppm basis OH | 50.0 | 50.0 | 50.0 | 50.0 | 50.0 |
| Chlorides in column, % | 12.0 | 21.0 | 15.0 | 6.0 | 22.0 |
| Chlorides in OH, % | 12.0 | 7.0 | 12.0 | 13.0 | 15.0 |
| Chlorides in solution, % | 59.0 | 67.0 | 67.0 | 64.0 | 56.0 |
| Flooding | No. | No | No | No | No |
| Visual Inspection | Clean no deposits. | Clean, very small amt. oily liquid Tray 15 & walls. | Clean, very small amt. oily liquid. Tray 15 & walls. | Clean, very small amt. oily liquid. Tray 15 & OH. OH. | Clean, very small amt. oily liquid. Tray 15 & OH. OH. |

[1]Sample from Jefferson Chemical Co.
[2]Sample from Vega Chemical Co.
[3]Sample from Worth Chemical Co.

TABLE III

| Evaluation of Competitive Neutralizers Charge: South Hampton Heavy Naphtha | | |
|---|---|---|
| Neutralizer | Comp. 6 | Comp. 6 |
| Injection point | Reflux line | Reflux line |
| Hours run | 22.0 | 22.0 |
| Water, % Basis OH | 4.4 | 3.9 |
| Chlorides charged, ppm basis OH | 43.0 | 41.0 |
| Chlorides in column, % | 46.0 | 38.0 |
| Chlorides in OH, % | 6.0 | 4.0 |
| Chlorides in solution, % | 48.0 | 51.0 |
| Flooding | No | No |
| Visual Inspection | Deposits Trays 10–15 | Deposits Trays 10–15 |

TABLE IV

| Effect of Hydrogen Sulfide on Deposit Formation Charge: Heavy Naphtha | | | | | | | | |
|---|---|---|---|---|---|---|---|---|
| Neutralizer | Comp. 2 | Comp. 2 | Comp. 2 | Comp. 2 | Comp. 1 | Comp. 1 | Comp. 1 | Comp. 1 |
| Hours run | 30 | 22 | 22 | 22 | 22 | 20 | 23 | 22 |
| Water, % basis OH | 3.7 | 4.0 | 3.7 | 4.2 | 4.5 | 3.7 | 3.8 | 3.8 |
| Chlorides charged, ppm basis OH | 50 | 50 | 50 | 50 | 50 | 50 | 50 | 50 |
| $H_2S$ charged, ppm basis OH | 0 | 0 | 72 | 78 | 0 | 0 | 70 | 78 |
| Chlorides in column, % | 25 | 14 | 26 | 26 | 15 | 21 | 6 | 22 |
| Chlorides in | | | | | | | | |

TABLE IV-continued

| | | | | | | | | |
|---|---|---|---|---|---|---|---|---|
| column OH, % | 11 | 19 | 12 | 22 | 12 | 7 | 13 | 15 |
| Chlorides in solution, % | 62 | 67 | 62 | 52 | 57 | 67 | 64 | 56 |
| Flooding | No | No | No | No | No | No | No | No |
| Visual Observation | Clean, V. lt depos. tray 15 & OH. | Clean, V. lt. depos. tray 15 & OH. | Clean, lt. depos. tray 15 & OH. | Clean, lt. depos. tray 15, mod. depos. OH. | Clean, V. lt. oily material tray 15 & OH. | Clean, V. lt. oily material tray 15 & OH. | Clean, V. lt. oily material tray 15 & OH | Clean, V. lt. oily material tray 15 & OH. |

To further illustrate the efficacy of the invention, methoxyethylamine and ethoxypropylamine were tested in accordance with the previously described procedure. The results of these tests are set forth below in Table V.

TABLE V

| Evaluation of Compounds Similar to HOPA | | | | |
|---|---|---|---|---|
| Neutralizer | Methoxyethylamine[1] | | Ethoxypropylamine[2] | |
| Run Number | 1 | 2 | 1 | 2 |
| Hours Run | 20 | 19 | 19 | 17 |
| Water, % Basis OH | 3.7 | 3.6 | 3.3 | 3.7 |
| Chlorides Charged, PPM Basis OH | 50 | 50 | 50 | 50 |
| Chlorides in Column, % | 12.3 | 12.2 | 18.7 | 23.6 |
| Chlorides in OH, % | 9.9 | 4.8 | 7.6 | 6.8 |
| Chlorides in Solution, % | 77.8 | 80.0 | 73.7 | 65.8 |
| Flooding | NO | NO | NO | NO |
| Visual Inspection | Clean, Very small amt. oily liquid Tray 15 | Clean, Very small amt. oily liquid Tray 15 & walls. | Clean, small amt. oil liquid Tray 15 & walls. | Clean small amt. oil liquid Tray 15 & walls. |

We claim:

1. A process for neutralizing the acidic components in the initial condensate of a distilling petroleum product in a refining unit which comprises: adding a neutralizing amount of a compound having the formula, R—O—$(CH_2)_n$ $NH_2$ wherein $n$ is 2 or 3 and R is a lower alkyl radical of not more than 4 carbon atoms to said petroleum product as it passes through the refining unit.

2. A process for neutralizing acidic components in the initial condensate of a distilling petroleum product in a refining unit which comprises: adding a neutralizing amount of methoxypropylamine to said petroleum product as it passes through the refining unit.

3. A process as in claim 2 wherein methoxypropylamine is added to the overhead line of the distilling unit.

4. A process as in claim 2 wherein methoxypropylamine is added to the petroleum product before said product is passed through the fractionating column of the distilling unit.

5. A process for neutralizing acidic components in the initial condensate of a distilling petroleum product in a refining unit which comprises: adding a neutralizing amount of methoxypropylamine to said petroleum product as it passes through the refining unit, the amount of methoxypropylamine added to said product being sufficient to raise the pH of the water of the initial condensate to above 4.0.

6. A process for neutralizing acidic components in the initial condensate of a distilling petroleum product in a refining unit which comprises: adding a neutralizing amount of methoxypropylamine to said petroleum product as it passes through the refining unit, the amount of methoxypropylamine added to said product being sufficient to raise the pH of the water of the initial condensate to at least about 5.0.

7. A continuous process for neutralizing the acidic components dissolved in the water of the initial condensate of a distilling petroleum product, which product is distilled in a distillation unit containing a fractionating tower and an overhead line which comprises continuously adding to the petroleum product being distilled a neutralizing amount of methoxypropylamine and continuously recycling the water condensed to the overhead line of the fractionating tower of the distilling unit.

8. A process as in claim 7 wherein the amount of methoxypropylamine added to said product is sufficient to raise the pH of the water of the initial condensate to above 4.0.

9. A process as in claim 7 wherein the amount of methoxypropylamine added to said product is sufficient to raise the pH of the water of the initial condensate to at least 5.0.

10. A method of neutralizing the acidic components dissolved in the water of the initial condensate in contact with the metal surfaces of a petroleum distilling unit which comprises: adding to the product being distilled a corrosion inhibiting amount of a film-forming amine along with methoxypropylamine in an amount sufficient to raise the pH of the water of the initial condensate to above 4.0.

11. A method of neutralizing the acidic components dissolved in the water of the initial condensate in contact with the metal surfaces of a petroleum distilling unit which comprises: adding to the product being distilled a corrosion inhibiting amount of a film-forming amine along with methoxypropylamine in an amount sufficient to raise the pH of the water of the initial condensate to at least about 5.0.

12. A process for neutralizing the acidic components in the initial condensate of a distilling petroleum product in a refining unit which comprises: adding a neutralizing amount of a compound having the formula, R-O-$(CH_2)_n$ $NH_2$ wherein $n$ is 2 or 3 and R is a lower alkyl radical of not more than 4 carbon atoms, to said petroleum product as it passes through the refining unit, the amount of said compound added to said product being sufficient to raise the pH of the water of the initial condensate to above 4.0.

13. A process as in claim 12 wherein the compound is added to the overhead line of the distilling unit.

14. A process as in claim 12 wherein the compound is added to the petroleum product before said product is passed through the fractionating column of the distilling unit.

15. A process for neutralizing the acidic components in the initial condensate of a distilling petroleum product in a refining unit which comprises: adding a neutralizing amount of a compound having the formula, R-O-$(CH_2)_n$$NH_2$ wherein $n$ is 2 or 3 and R is a lower alkyl radical of not more than 4 carbon atoms to said petroleum product as it passes through the refining unit, the amount of said compound added to said product being sufficient to raise the pH of the water of the initial condensate to at least about 5.0.

16. A continuous process for neutralizing the acidic components dissolved in the water of the initial condensate of a distilling petroleum product, which product is distilled in a distillation unit containing a fractionating tower and an overhead line which comprises continuously adding to the petroleum product being distilled a neutralizing amount of a compound having the formula, $R\text{-}O\text{-}(CH_2)_n NH_2$ wherein *n* is 2 or 3 and R is a lower alkyl radical of not more than 4 carbon atoms, and continuously recycling the water condensed to the overhead line of the fractionating tower of the distilling unit.

17. A process as in claim 16 wherein the amount of the compound added to said product is sufficient to raise the pH of the water of the initial condensate to above 4.0.

18. A process as in claim 16 wherein the amount of the compound added to said product is sufficient to raise the pH of the water of the initial condensate to at least 5.0.

19. A method of neutralizing the acidic components dissolved in the water of the initial condensate in contact with the metal surfaces of a petroleum distilling unit which comprises: adding to the product being distilled a corrosion inhibiting amount of a film-forming amine along with a compound having the formula, $R—O—(CH_2)_nNH_2$ wherein *n* is 2 or 3 and R is a lower alkyl radical of not more than 4 carbon atoms, in an amount sufficient to raise the pH of the water of the initial condensate to above 4.0.

20. A method of neutralizing the acidic components dissolved in the water of the initial condensate in contact with the metal surfaces of a petroleum distilling unit which comprises: adding to the product being distilled a corrosion inhibiting amount of a film-forming amine along with a compound having the formula, $R—O—(CH_2)_nNH_2$ wherein *n* is 2 or 3 is a lower alkyl radical of not more than 4 carbon atoms, in an amount sufficient to raise the pH of the water of the initial condensate to at least about 5.0.

* * * * *